United States Patent [19]

Yamashita

[11] 4,314,497

[45] Feb. 9, 1982

[54] PIANO CONSTRUCTION FOR ENRICHED STEREOPHONIC TONAL RADIATION

[75] Inventor: Hideo Yamashita, Hamamatsu, Japan

[73] Assignee: Nippon Gakki Seizo Kabushiki Kaisha, Japan

[21] Appl. No.: 183,309

[22] Filed: Sep. 2, 1980

Related U.S. Application Data

[63] Continuation of Ser. No. 919,724, Jun. 27, 1978, abandoned.

[30] Foreign Application Priority Data

Jul. 1, 1977 [JP] Japan ..... 52-87223

[51] Int. Cl.[3] ..... G10C 3/02

[52] U.S. Cl. ..... 84/177

[58] Field of Search ..... 84/177-182, 84/189-191, 346, 372, 192-196

[56] References Cited

U.S. PATENT DOCUMENTS

| | | | |
|---|---|---|---|
| 407,695 | 7/1889 | Schaaf | 84/177 |
| 448,032 | 3/1891 | Hastings | 84/177 |
| 2,249,978 | 7/1941 | Pfaff | 84/177 |
| 2,387,491 | 10/1945 | Bethune | 84/177 |
| 2,486,354 | 10/1949 | Zaiser | 84/177 |

FOREIGN PATENT DOCUMENTS

| | | | |
|---|---|---|---|
| 524597 | 8/1940 | United Kingdom | 84/189 |

OTHER PUBLICATIONS

Seeburg, 9-1926, Cele Sta De Luxe Player Pipe Organ, Advertisement.

*Primary Examiner*—Joseph W. Hartary
*Assistant Examiner*—Thomas H. Tarcza
*Attorney, Agent, or Firm*—Ostrolenk, Faber, Gerb & Soffen

[57] ABSTRACT

At least one board defining the front side of the resonant cavity of a piano is provided with at least a pair of outwardly diverging vertical slits arranged an appreciable distance away from each other and on opposite sides of the center of the piano for smooth radiation of tonal atmospheric vibrations generated in the cavity by striking of strings to the atmospheric space in front of the piano, thereby providing ideal stereophonic acoustic effect to the player or listeners and avoiding any biased cavity resonance and mixing of undesirable noises. A selectively openable construction of the slit enables free selection of the tonal radiation in accordance with the requirements of the performance.

12 Claims, 9 Drawing Figures

Fig. 1
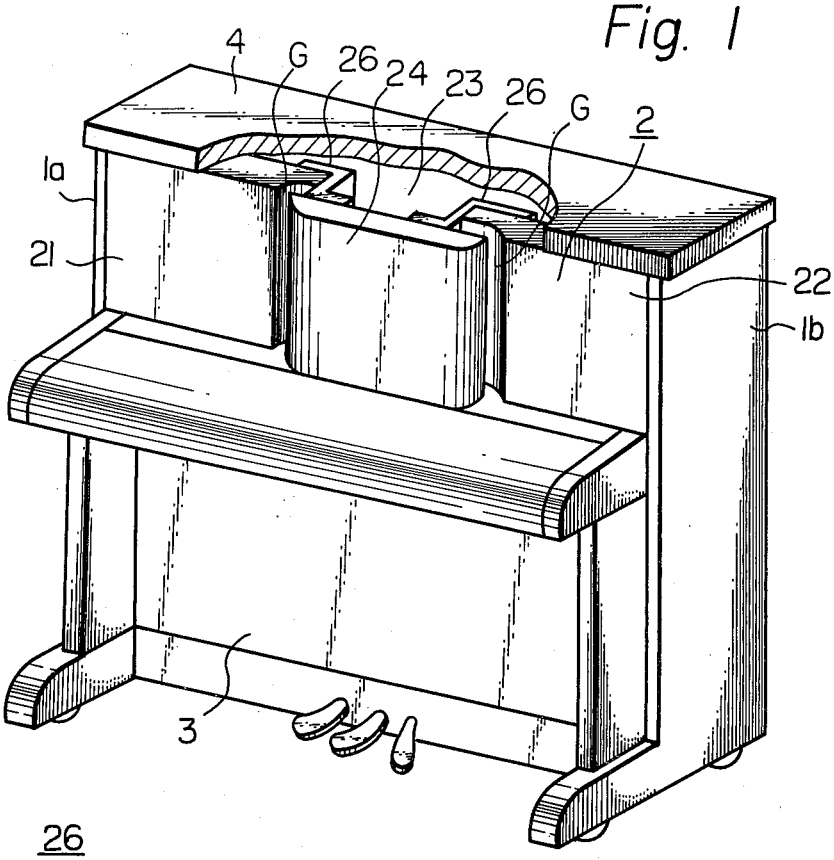
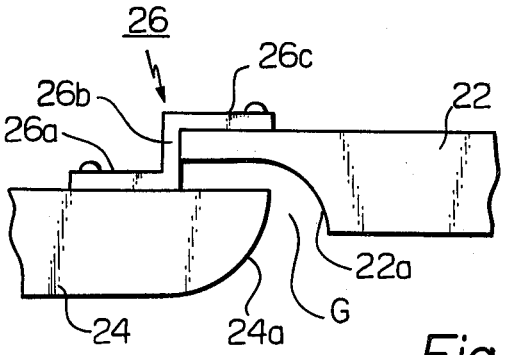
Fig. 2
Fig. 3
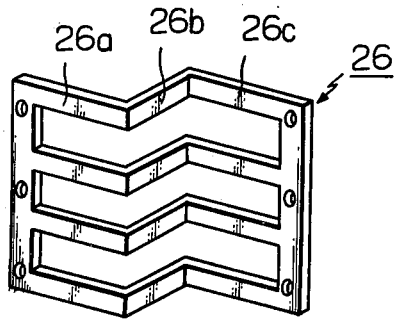
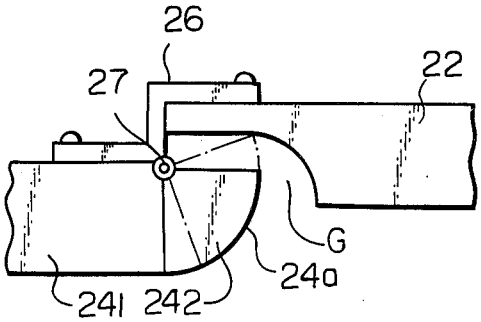
Fig. 4

PIANO CONSTRUCTION FOR ENRICHED STEREOPHONIC TONAL RADIATION

RELATED APPLICATIONS

This is a continuation of U.S. patent application Ser. No. 919,724 filed June 27, 1978 now abandoned.

BACKGROUND OF THE INVENTION

The present invention relates to an improved piano construction for enriched stereophonic tonal radiation, and more particularly relates to improvement in the construction of a board or boards defining the front side of the resonant cavity of an upright type piano for enriched tonal radiation into atmospheric spaces in front of the piano.

A casing for an upright type piano functions as a kind of resonance box having a cavity defined by a top board, a pair of sides, a front board and a bottom board and the back side of the box is closed by a sound board over which a number of strings are arranged in a tightly stretched state. As a string is struck, vibration of the string is transmitted to the sound board via a bridge arranged on the sound board in order to support the string. Vibration of the sound board so caused generates corresponding atmospheric vibration within the cavity which is perceived as a tone by the audience. In this tone generating mechanism, the cavity resonance, i.e. the above-described atmospheric vibration within the cavity, plays an important role in obtaining a beautiful acoustic effect.

Usually, an upright type piano is placed in a room with the back side very close to a wall of the room. Therefore, although the sound board is exposed on the back side of the piano, the back side of the cavity is in most cases actually closed by the wall surface. In other words, the resonant cavity is actually of a completely closed construction and the tones are apt to be confined in this closed resonant cavity. Such complete tonal confinement tends to cause biased resonance of the cavity to tones of particular frequencies only, which seriously degrades the tone quality of the piano.

In one conventional proposal for releasing such tonal confinement, a relatively large screen is formed in the lower front board in order to enable forward radiation of the tones. However, presence of such a large opening in the board of the casing often results in very poor resonance of the cavity and generation of noises at striking of strings, both leading to generation of deteriorated musical tones.

In another conventional proposal for mitigating such tonal confinement a relatively small opening is formed on the front side of the resonant cavity by opening a music rack arranged above the keyboard. However, presence of such a small opening in the front board of the casing cannot actually assure sufficient balanced radiation of tones over all tone ranges.

In both conventional examples further, it is quite impossible to freely select the tonal radiation, the tonal radiation therefore lacks in directivity and the acoustic effect of the tones generated by the piano is rather monophonic.

SUMMARY OF THE INVENTION

It is one object of the present invention to provide a piano construction which enables smooth, external radiation of tones generated in the resonant cavity.

It is another object of the present invention to provide a piano construction which assures ideal stereophonic acoustic effect to the player or audience.

It is the other object of the present invention to provide a piano construction which assures freedom in selection of tonal radiation in accordance with requirement in the performance of the piano.

In accordance with the the present invention, at least a pair of outwardly diverging vertical slits are formed in at least one board defining the front end of the resonant cavity of a piano. The slits are arranged appreciably distant from each other on opposite sides of the center of the board. The slits are selectively openable.

In one preferred embodiment of the present invention, two or more slits are formed in about the middle of the upper front board of the piano.

In another preferred embodiment of the present invention, two or more slits are formed in about the middle of the lower front board of the piano.

In the other preferred embodiment of the present invention, one or more slits are formed in either side fringe or fringes of the lower front board.

A further preferred embodiment of the present invention takes the form of a combination of at least two of the foregoing embodiments.

BRIEF DESCRIPTION OF THE DRAWINGS

FIG. 1 is a partly cut away perspective view of one embodiment of the piano construction in accordance with the present invention, FIG. 2 is a fragmentary top view of the slit and its related parts in the construction shown in FIG. 1, FIG. 3 is a perspective view of the connector used in the construction shown in FIG. 1, FIG. 4 is a fragmentary top view of the slit and its related parts in a variant of the construction shown in FIG. 1.

DESCRIPTION OF THE PREFERRED EMBODIMENTS

Figure 5:
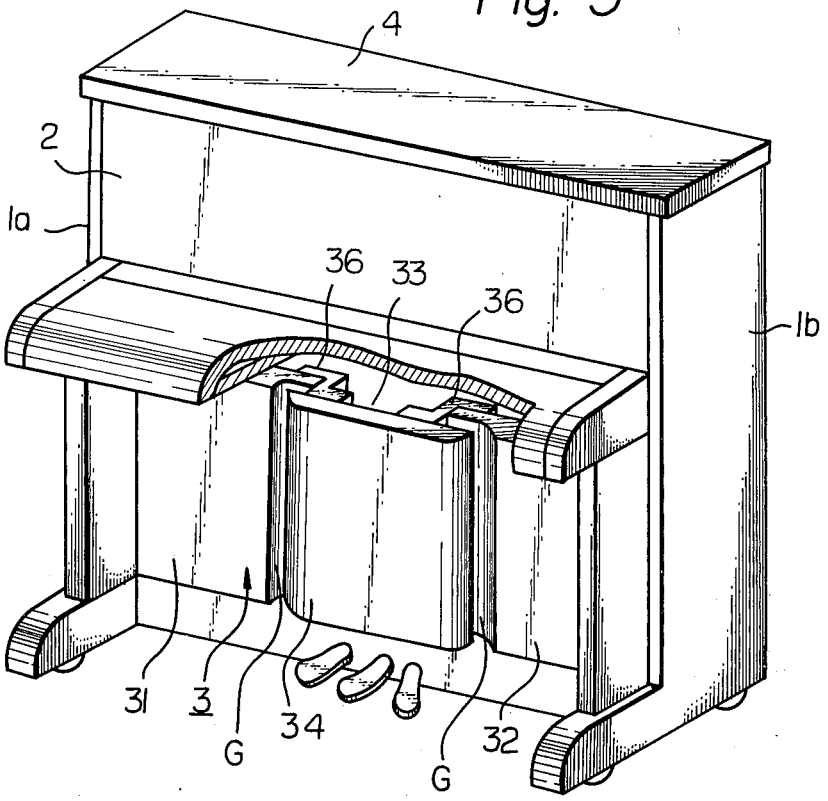
FIG. 5 is a partly cut away perspective view of another embodiment of the piano construction in accordance with the present invention.

One embodiment of the improved piano construction in accordance with the present invention is shown in FIG. 1, in which the present invention is applied to the construction of an upper front board of an upright type piano. The casing of the piano is formed by a pair of sides 1*a*, 1*b*, an upper front board 2, a lower front board 3, a top board 4 and a bottom board (not shown) with the back side of the casing being closed by a sound board. Like the conventional pianos, the casing accommodates a metallic piano frame arranged close to the sound board, a number of vibratory strings stretched on the piano frame in engagement with bridges arranged on the sound board, an action assembly operationally related to keys and the strings so that the strings are struck for tonal vibration when corresponding keys are operated. Tonal vibrations of the strings are transmitted to the sound board via the bridges. The casing as a whole functions as a kind of resonance box for vibration of the sound board.

The upper front board 2 used in this embodiment is formed by a pair of side component boards 21 and 22 arranged in alignment with each other while leaving at the central part of the upper front board 2 a center opening 23 which is spacedly covered by a center component board 24.

As shown in FIG. 2, each lateral end portion of the center component board 24 is preferably defined by a substantially vertical, round and curved plane 24*a* which is outwardly convex. The corresponding lateral end portion of the side component board 22 (or 21) is preferably defined by a substantially vertical, round and curved plane 22*a* (or 21*a*) which is outwardly concave. The center component board 24 and the side component boards 21, 22 are coupled, at mating lateral end portions, to each other by connectors 26 such as the one, for example, shown in FIG. 3. The connector 26 is here given in the form of a bent metal strap which is made up of three sections 26*a*, 26*b* and 26*c*. The first and third sections 26*a* and 26*c* are almost parallel to each other and the second section 26*b* connects the other two sections 26*a* and 26*c*. For example, the first section 26*a* is adapted for screw fixing to the back face of the lateral end portion of the center component board 24 while the third section is adapted for fixing by screw to the back face of the lateral end portion of the side component board 22 (or 21). The length of the second section 26*b* is larger than the thickness of the fringe of the side component board 22 (or 21) so that a slit G is formed between the center component board 24 and the side component board 22 (or 21) along the associated lateral end. Due to combination of the above-described round contours of the associated ends portions of both components 24 and 22 (or 21), the slit G diverges outwards. This characteristic shape of the slit G will hereinafter be referred to as "the exponential divergence" and the slit G itself will hereinafter be referred to as "the exponentially diverging slit".

This exponentially diverging slit G clearly connects the upper interior cavity of the casing, i.e. the resonance box, the to the exterior atmosphere in front of the casing via the center opening 23 and provides a passage for atmospheric vibrations within the casing cavity to the exterior atmosphere. In other words, the tonal atmospheric vibrations within the casing cavity generated by striking the strings are smoothly radiated into the exterior atmosphere in front of the piano through the slit G and are widely dispersed into the intended direction due to the exponential divergence of the slit G.

Arrangement of the strings for the three tonal ranges with respect to the sound board on the upright type piano are in general as follows.

The strings for the bass range run from the upper left towards the lower middle over the sound board and a bass bridge is arranged on the sound board along the lower ends of the strings. The strings for the middle range run from the upper middle towards the lower left and lower middle over the sound board. The strings for the treble range are located about the upper right over the sound board. The treble bridge runs from the lower left to the upper right on the sound board along the lower ends of the strings in the middle and treble ranges.

Thus, the above-described exponentially diverging slit G formed on the left side of the center component board 24 contributes to external radiation of the middle tones whereas that formed on the right side of the center component board 24 contributes to external radiation of the treble tones.

Taking the above-described local difference in external radiation of tones into consideration, the embodiment shown in FIG. 4 contempletes selective radiation of tones. In the case of this embodiment, the center component board 24 is comprised of a center panel 241 and a pair of end pieces 242, only one of which is illustrated in the drawing. The end piece 242 provides the substantially vertical, round and curved plane 24*a* and is provided with a quadrant transverse cross sectional profile. The end piece 242 is pivoted at the back corner to the back end corner of the center panel via a hinge joint 27. When the end piece 242 assumes the position shown with the solid lines, it provides the exponentially diverging slit G for tonal radiation. When the end piece 242 is turned to assume the position shown with the phantom lines, it closes the slit G in order to block the tonal radiation.

Therefore, when it is required to stress the middle tones in the performance of the piano, only the left side slit G is left open in order to allow external radiation of the middle tones, with the right side slit G being closed. On the contrary, when only the right side slit G is left open and the left side slit G is closed, the treble tones are stressed in the performance. Thus, the construction shown in FIG. 4 assures freedom in selection of tonal radiation in accordance with particular requirement in the performance of the piano.

Another embodiment of the improved piano construction in accordance with the present invention is shown in FIG. 5, in which the present invention is applied to the construction of a lower front board of an upright type piano. In the illustration, members substantially similar to those used in the foregoing embodiments are designated with similar reference numerals and symbols.

The lower front board 3 used in this embodiment is formed by a pair of side component boards 31 and 32 arranged in alignment to each other while leaving at the central part of the lower front board a center opening 33 which is spacedly covered by a center component board 34. Like the embodiment shown in FIG. 1, each lateral end portion of the center component board 34 is preferably defined by a substantially vertical, round and curved plane which is outwardly convex. The corresponding lateral end portion of the side component board 32 (or 31) is preferably defined by a substantially vertical, round and curved plane which is outwardly concave. The center component board 34 and the side component boards 31 and 32 are coupled, at mating end portions, to each other by connectors 36 preferably similar to the ones 26 used in the foregoing embodiments. Due to combination of the above-described round contours of the mating end portions of both components 34 and 32 (or 31), an exponentially diverging slit G is formed between the center component board 34 and the side component board (or 21) in the mating area.

This exponentially diverging slit G clearly connects the center portion of the lower interior cavity of the casing, i.e. the resonance box, to the exterior atmosphere in front of the casing via the center opening 33 and provides a passage for atmospheric vibrations within the casing cavity to the exterior atmosphere. In other words, the tonal atmospheric vibrations within the casing cavity generated by striking the strings are smoothly radiated into the exterior atmosphere in front of the piano through the slit G and widely dispersed into the purposed direction due to the exponential divergence of the slit G.

The bass bridge is arranged on the sound board along the lower ends of the strings for the bass range, which are located about the lower right over the sound board and the bridge for the middle range is located about the lower left over the sound board. Thus, the above-described exponentially diverging slit G formed on the left side of the center component board 34 contributes to external radiation of the middle tones whereas that formed on the right side of the center component board 34 contributes to external radiation of the bass tones.

A modification like the one shown in FIG. 4 is employable in this embodiment also for the purpose of free selection of tonal radiation in accordance with a particular requirement in the performance of the piano. That is, for emphasis of the middle tones in the performance, only the left side slit G is left open and only the right side slit G is left open for emphasis of the bass tones.

Figure 6:
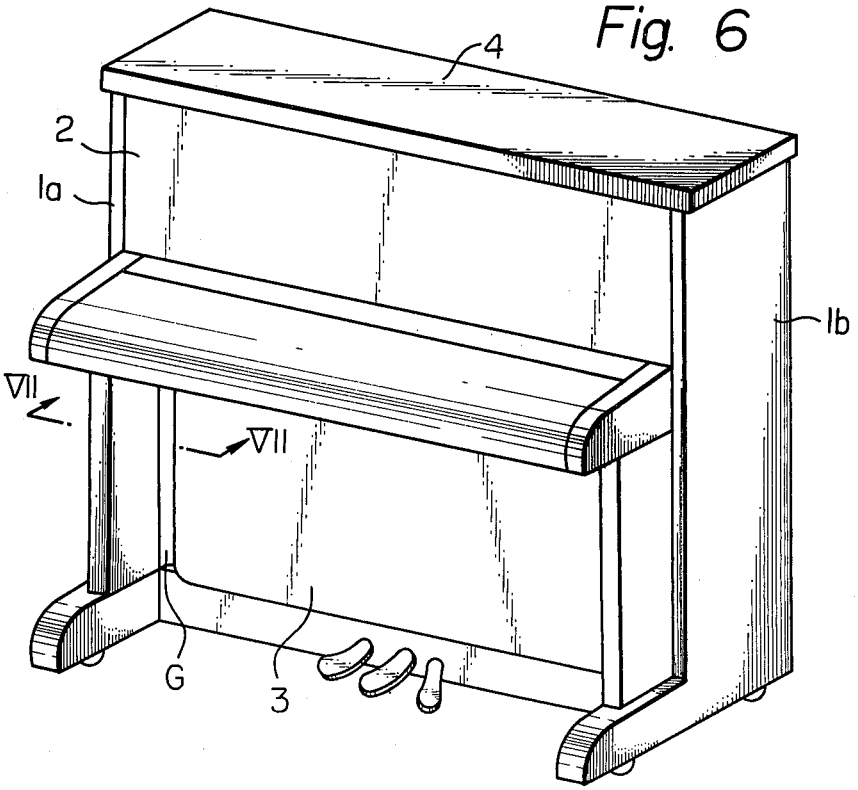
FIG. 6 is a perspective view of the other embodiment of the piano construction in accordance with the present invention.
Figure 7:
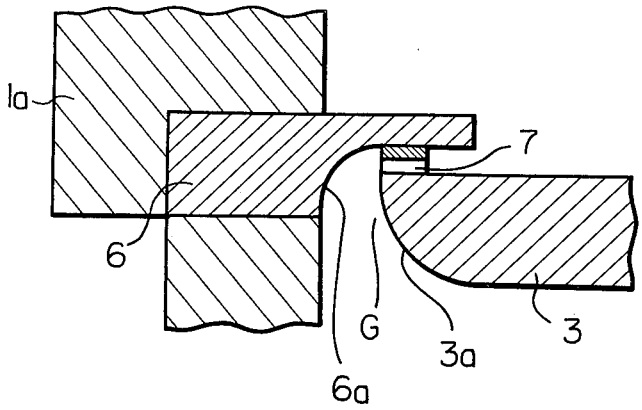
FIG. 7 is a section taken along the line VII—VII in FIG. 6.

A further embodiment of the improved piano construction in accordance with the present invention is shown in FIGS. 6 and 7, in which the present invention is applied to the coupling construction of a lower front board to sides of an upright type piano. In the illustration, members substantially similar to those used in the foregoing embodiments are designated with similar reference numerals and symbols.

Figure 8:
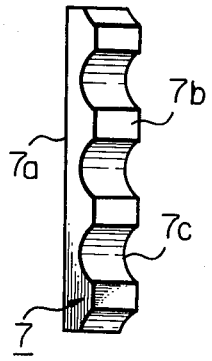
FIG. 8 is a perspective view of the spacer used in the construction shown in FIG. 7.

As shown in FIG. 7 in detail, each end portion of the lower front board 3 is preferably defined by a substantially vertical, round and curved plane 3*a* which is outwardly convex. The corresponding end portion of a connecting block 6 is preferably defined by a substantially vertical, round and curved plane 6*a* which is outwardly concave. The lower front board 3 and the connecting block 6 are coupled, at the mating end portions, to each other by spacers 7 such as the one, for example, shown in FIG. 8. The spacer 7 is in the form of an elongated rod having side faces 7*a* and 7*b* adapted for snug engagement by bonding to the associated faces of the lower front board 3 and the connecting block 6 and is provided with a number of transversal grooves 7*c* formed in at least one of the above-described side faces. As shown in FIG. 7, the spacers 7 are inserted between the front face of the end portion of the connecting block 6 and the back face of the end portion of the lower front board 3 so that a slit G is formed between the two members 3 and 6 in the mating area thereof. Due to the above-described round contour of the end portions of both components 3 and 6, the slit G is provided with the exponential divergence. Instead of the spacer 7 shown in FIG. 8, felt strips may be used to form the slit G.

This exponentially diverging slit G clearly connects the side portions of the lower interior cavity of the casing, i.e. the resonance box, to the exterior atmosphere in front of the casing and provides a passage for atmospheric vibrations within the casing cavity to the exterior atmosphere. In other words, the tonal atmospheric vibrations within the casing cavity generated by striking the strings are smoothly radiated into the exterior atmosphere in front of the piano through the slit G and widely dispersed in the intended direction due to the exponential divergence of the slit G. These side slits G enable successful external radiation of tonal atmospheric vibrations which otherwise would be confined to the side lower corners of the casing cavity.

A modification like the one shown in FIG. 4 is employable in this embodiment also when the spacers 7 are replaced by the connectors shown in FIG. 3, thereby enabling free selection of tonal radiation in accordance with a particular requirement in the performance of the piano.

It should be noted also that the connectors 26 used in the embodiments shown in FIGS. 1 and 5 can be replaced by the spacers 7 used in the embodiment shown in FIG. 6.

The exponentially diverging slit G may be formed either continuously or discontinuously in the vertical direction of the relevant board and the dimension, particularly the width, of the opening of the slit G, may be changed on both sides of the relevant board.

The width of the slit G is preferably in a range from 2 to 20 mm. and the total effective length of the slit G is in a range from 200 to 500 mm. In one actual example of the constructions shown in FIGS. 1 and 5, the width, i.e. the horizontal length, of the side component board 21 or 22 (31 or 32) is 386 mm. and that of the center component board 24 (or 34) is 750 mm.

The number of the slits to be formed in the front board 2 (or 3) in the embodiment shown in FIGS. 1 and 5 may be larger than 2 in accordance with requirement in the actual performance.

Figure 9:
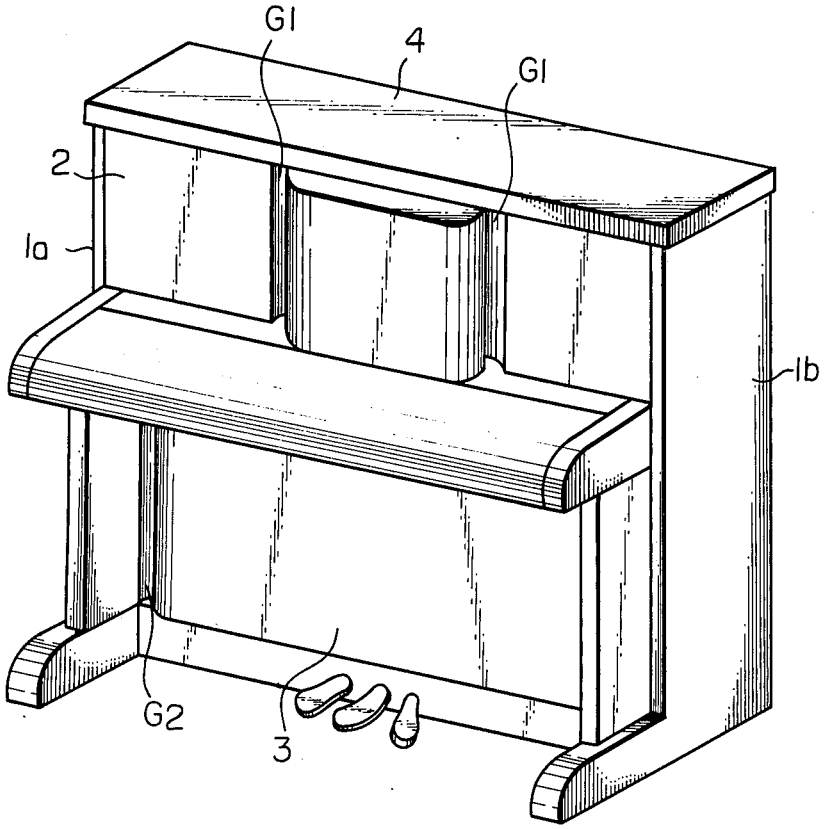
FIG. 9 is a perspective view of a further embodiment of the piano construction in accordance with the present invention.

The embodiment shown in FIG. 9 is a combination of the constructions shown in FIGS. 1 and 6. It has two exponentially diverging slits G 1 formed in the middle area of the upper front board 2 serving for external radiation of the middle and treble tones, and two exponentially diverging slits G 2 formed in the side fringe areas of the lower front board 3 for external radiation particularly of the bass tones.

When the piano is provided with this construction, tones of different tonal ranges are radiated from the piano into the front space. The bass tones are radiated towards the middle area of the space, the middle tones are radiated towards the left area of the space, and the treble tones are radiated towards the right area of the space. Such directivity in the tone radiation provides stereophonic acoustic effect to the player or listeners which is by far superior to the monophonic effect provided by the conventional pianos. When the slits are accompanied with the selectively openable construction, freedom in selection of the tonal radiation assures further colourful control of the stereohonic acoustic effect. Further, moderately controlled external radiation of tones from the casing cavity successfully avoids any biased cavity resonance and mixing of undesirable noises at striking of the strings. Thus, clear and enriched tonal quality can be obtained through employment of the present invention.

I claim:

1. An improved piano construction for enriched stereophonic tonal radiation, comprising:

a resonant cavity including a front board defining a front end of said cavity, said resonant cavity having first, second and third areas in which treble, mid-range and base tones, respectively, predominate;

first and second tone radiating slits formed in said front board; said first and second slits being the only tone radiating slits formed in said front board; said first slit having a shape and location corresponding to one of said first, second and third areas so that said first slit radiates primarily a first tone range from within said cavity to the area in front of said front board whereby said slit operates primarily as a firt tone range source; said second slit having a shape and location corresponding to a different one of said first, second and third areas such that said second slit radiates primarily a second tone range different than said first tone range from within said cavity to the area in front of said front board whereby said second slit operates primarily as a second tone range source; and each of said slits having an exponentially diverging shape which causes the tones radiated thereby to radiate over a wide area in front of said front board.

2. Improved piano construction as claimed in claim 1 in which said front board has an upper and a lower portion and said slits are formed in said upper portion of said front board.

3. Improved piano construction as claimed in claim 2 in which said slits are arranged about the middle of said upper portion of said front board.

4. Improved piano construction as claimed in claim 1 in which said front board has an upper and a lower portion and said slits are formed in said lower portion of said front board.

5. Improved piano construction as claimed in claim 4 in which said slits are arranged about the middle of said lower portion of said front board.

6. Improved piano construction as claimed in claim 4 in which said slits are arranged about either side fringe of said lower portion of said front board.

7. An improved piano construction for enriched stereophonic tonal radiation, comprising:

a resonant cavity including a front board defining a front end of said cavity; said front board having an upper portion and a lower portion; said resonant cavity having first, second and third areas in which treble, mid-range and base tones, respectively, predominate;

first and second tone radiating slits formed in said upper portion of said front board; said first and second slits being the only tone radiating slits formed in said upper portion of said front board; said first slit having a shape and location corresponding to one of said first, second and third areas so that said first slit radiates primarily a first tone range from within said cavity to the area in front of said front board whereby said first slit operates primarily as a first one range source; said second slit having a shape and location corresponding to a different one of said first, second and third areas such that said second slit radiates primarily a second tone range different than said first tone range from within said cavity to the area in front of said front board whereby said second slit operates primarily as a second tone range source;

third and fourth tone radiating slits formed in said lower portion of said front board, said third and fourth tone radiating slits being the only tone radiating slits formed in said lower portion of said front board; said third slit having a shape and location corresponding to one of said first, second and third areas so that said third slit radiates primarily a third tone range from within said cavity to the area in front of said front board whereby said third slit operates primarily as a third tone range source; said fourth slit having a shape and location corresponding to a different one of said first, second and third areas than said third slit such that said fourth slit radiates primarily a fourth tone range from within said cavity to the area in front of said front board whereby said fourth slit operates primarily as a fourth tone range source; and each of said slits having an exponentially diverging shape which causes the tones radiated thereby to radiate over a wide area in front of said front board.

8. Improved piano construction as claimed in claim 7 in which said pair of slits in said upper portion of said front board are arranged about the middle of said upper portion of said front board.

9. Improved piano construction as claimed in claim 8 in which said pair of slits in said lower portion of said front board are arranged about the middle of said lower portion of said front board.

10. Improved piano construction as claimed in claim 8 in which said pair of slits in said lower portion of said front board are arranged about either side end of said lower portion of said front board.

11. Improved piano construction as claimed in any one of claims 1, 2, 4 or 7 comprising means for selectively opening each said slit.

12. Improved piano construction as claimed in claim 1 in which said selective opening means includes a plurality of end pieces, each of said end pieces corresponding to a respective said slit and hinged to said front board adjacent its respective said slit and defining one side wall of said slit.

* * * * *